US006598440B1

(12) United States Patent
Armstrong

(10) Patent No.: US 6,598,440 B1
(45) Date of Patent: Jul. 29, 2003

(54) LOCKSET MECHANISM HAVING A SEMI-PERMANENT MECHANICAL CONNECTION

(75) Inventor: Steven Armstrong, Anaheim, CA (US)

(73) Assignee: Newfrey LLC, Newark, DE (US)

( * ) Notice: Subject to any disclaimer, the term of this patent is extended or adjusted under 35 U.S.C. 154(b) by 161 days.

(21) Appl. No.: 09/721,215

(22) Filed: Nov. 22, 2000

Related U.S. Application Data

(60) Provisional application No. 60/167,884, filed on Nov. 24, 1999.

(51) Int. Cl.[7] ..... E05B 55/04

(52) U.S. Cl. ..... 70/472; 70/224; 292/336.3; 292/347; 292/352; 292/358

(58) Field of Search ..... 70/224, 448–452, 70/466, 472; 292/336.3, 352, 353, 356, 357, 347, 348; 16/412–414, 441

(56) References Cited

U.S. PATENT DOCUMENTS

| | | | | |
|---|---|---|---|---|
| 2,027,608 | A | 1/1936 | Moller | 292/357 |
| 2,357,102 | A | 8/1944 | Gold | 292/356 |
| 2,491,783 | A | 12/1949 | Thomas | 292/169 |
| 2,536,494 | A | 1/1951 | Erkkila | 292/357 |
| 2,728,597 | A | 12/1955 | Young | 292/347 |
| 2,778,667 | A | 1/1957 | Young | 292/352 |
| 2,803,482 | A | 8/1957 | Zion | 292/347 |
| 2,810,600 | A | 10/1957 | Kendrick | 292/357 |
| 2,827,323 | A | 3/1958 | Kessel et al. | 292/352 |
| 3,136,572 | A | 6/1964 | Lytle | 292/336.3 |
| 3,143,873 | A | 8/1964 | Hillgren | 70/147 |
| 3,228,218 | A | 1/1966 | Wilson | 70/146 |
| 3,677,593 | A | 7/1972 | Wahlberg | 292/356 |
| 4,502,720 | A | 3/1985 | Fayerman et al. | 292/348 |
| 4,789,191 | A | 12/1988 | Dennis | 292/347 |
| 4,869,083 | A | 9/1989 | DeMarseilles et al. | 70/224 |
| 4,921,289 | A | 5/1990 | Shen | 292/336.3 |
| 4,930,822 | A | 6/1990 | Shen | 292/357 |
| 5,118,152 | A | 6/1992 | Lin | 292/356 |
| 5,149,155 | A | 9/1992 | Caeti et al. | 292/336.3 |
| 5,409,278 | A | 4/1995 | Harcourt et al. | 292/357 |
| 5,590,555 | A | 1/1997 | Kester et al. | 70/224 |
| 5,960,517 | A | 10/1999 | Sprekeler | 292/357 |
| 5,983,683 | A | 11/1999 | Shen | 70/224 |

*Primary Examiner*—Suzanne Dino Barrett
(74) *Attorney, Agent, or Firm*—Harness, Dickey & Pierce, P.L.C.

(57) ABSTRACT

A lockset mechanism having a semi-permanent mechanical connection between the interior and exterior components thereof is provided. The lockset mechanism includes an exterior cylinder assembly releasably coupled to a mounting plate, an interior cylinder assembly having a locking blade interdisposed between the mounting plate and the interior cylinder assembly for providing a semi-permanent mechanical connection. The locking blade is rotatably positionable from an unlocked position wherein the interior cylinder assembly is uncoupled from the mounting plate to a locked position wherein the interior cylinder assembly is coupled to the mounting plate upon rotation of a knob assembly.

21 Claims, 10 Drawing Sheets

FIG 11
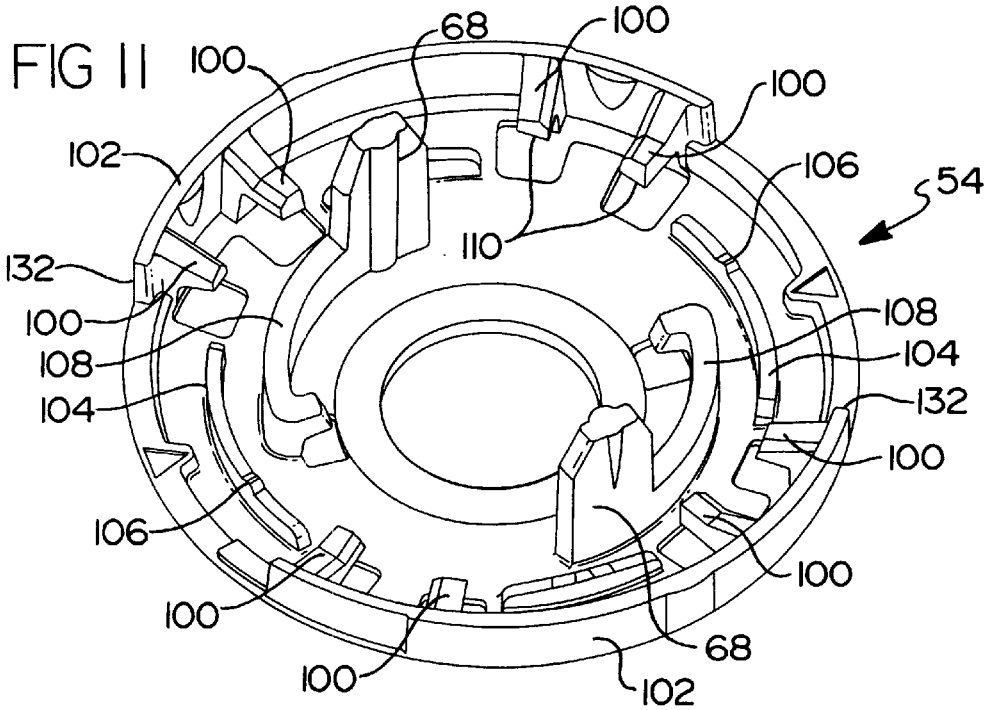
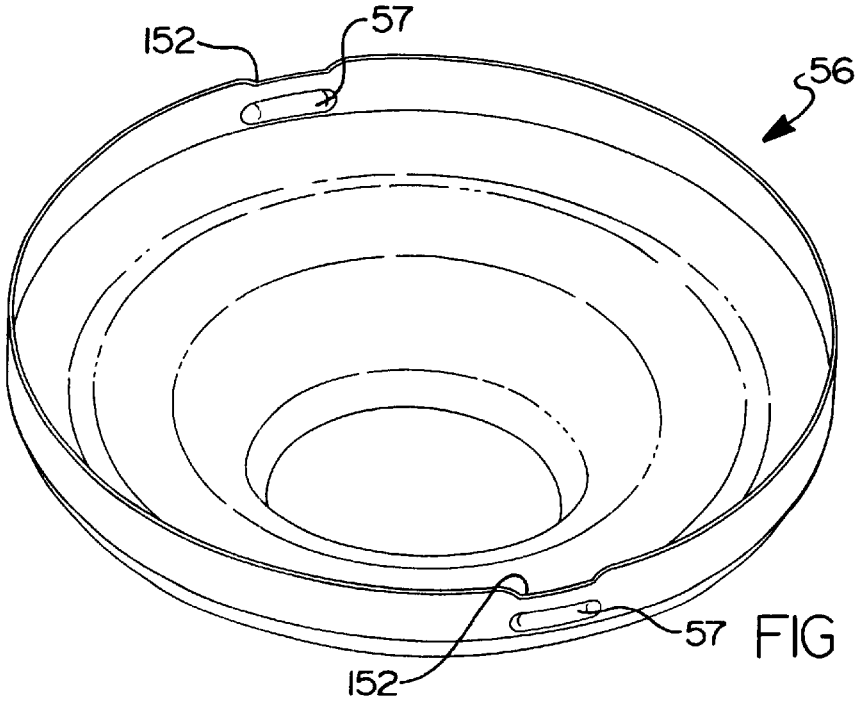
FIG 12

FIG 16
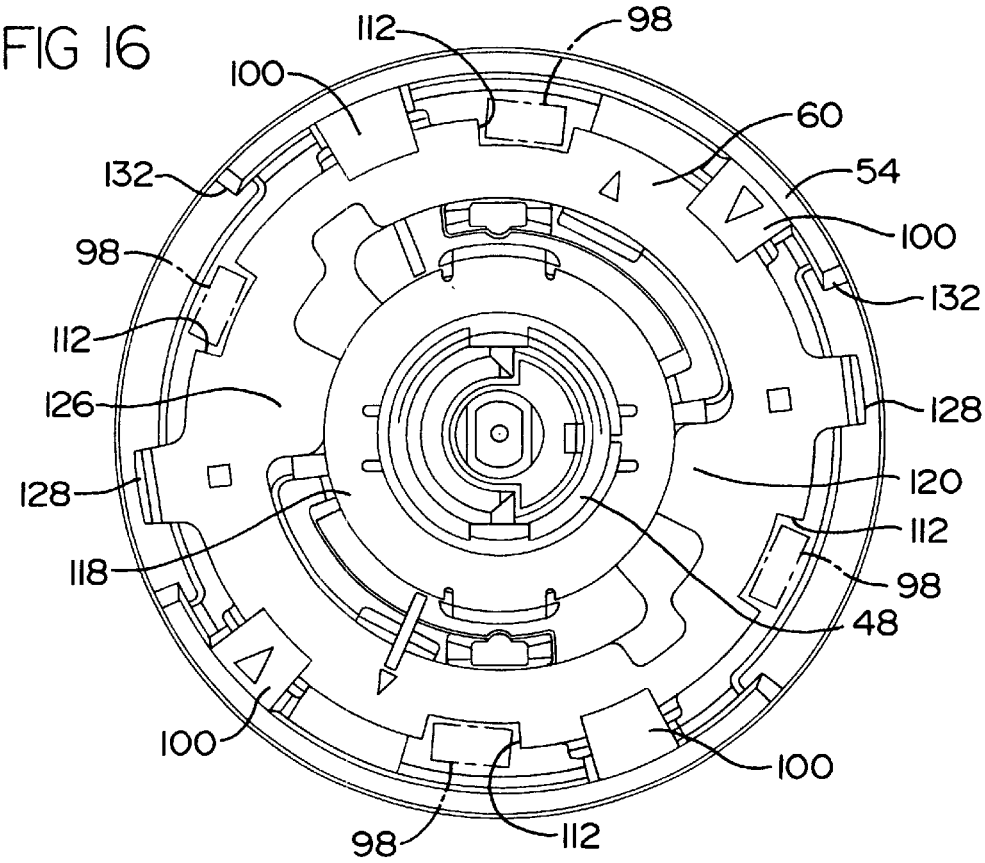
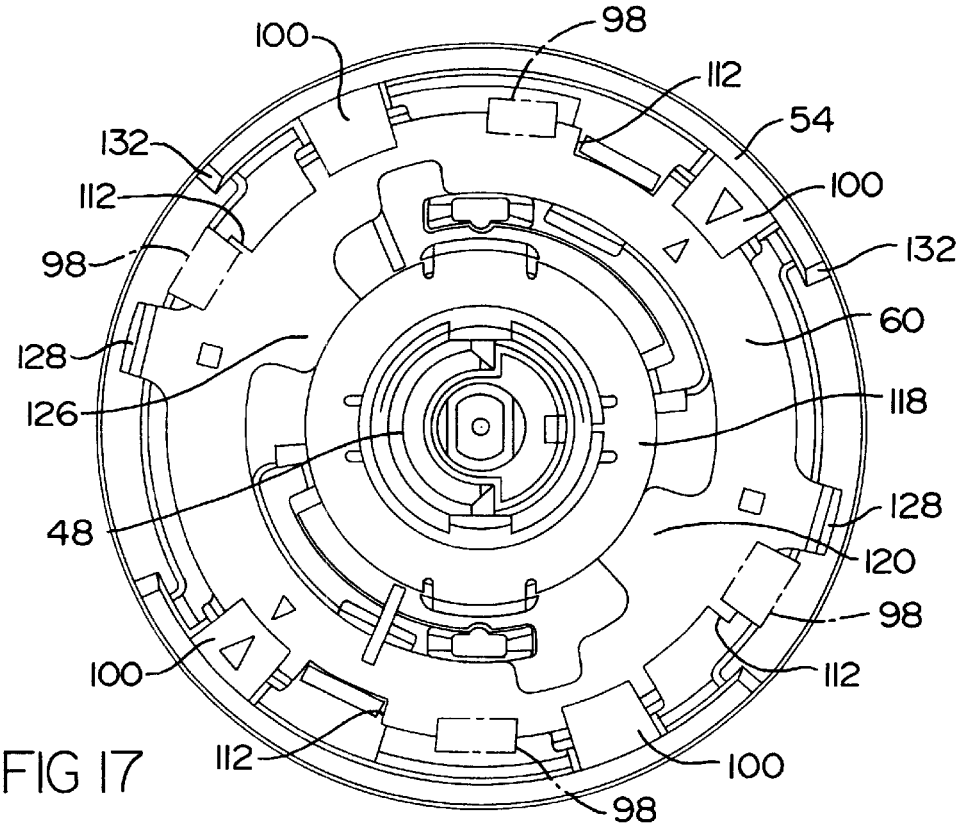
FIG 17

LOCKSET MECHANISM HAVING A SEMI-PERMANENT MECHANICAL CONNECTION

CROSS REFERENCE TO RELATED APPLICATION

This application claims priority under 35 U.S.C. §119(e) to U.S. Provisional Application No. 60/167,884 filed on Nov. 24, 1999, and entitled "Lockset Mechanism Having A Semi-Permanent Mechanical Connection" the specification and drawings of which are hereby expressly incorporated by reference.

BACKGROUND AND SUMMARY OF THE INVENTION

This invention relates generally to a lockset mechanism for a door assembly, and more specifically to a means and method for establishing a semi-permanent mechanical connection between the interior and exterior cylinder assemblies of a lockset mechanism.

In conventional locksets, the interconnection between the interior and exterior rose assemblies is established by the use of threaded fasteners. The exterior rose assembly typically includes two internally threaded bosses which align with two apertures formed on the interior rose assembly. Standard machine screws are inserted into the interior rose apertures and are brought into alignment with and threadingly engage the threaded bosses formed on the exterior rose assembly. Tightening the screws closes the interior and exterior roses toward each other, thereby trapping the door therebetween. A typical lockset of the type described above is illustrated in FIG. 1.

There are numerous disadvantages to this conventional method of establishing a semi-permanent mechanical connection between the interior and exterior rose assemblies of the lockset. In particular the access to the screw heads may be partially concealed behind the door knob making manipulation awkward. In addition, the screws typically used for this purpose are relatively long (often 1 inch or more in total length) to permit a single lockset to accommodate doors of varying thicknesses, typically in the range of 1⅜ to 1¾ inch door thicknesses. The length of the screws requires that the screws be turned many times when the lockset is being installed on thinner doors, thereby reducing the speed of installation. Furthermore, the bosses must be internally threaded deeply enough to accommodate the length of the screws when the lockset mechanism is installed on thinner doors. Such deep internally threaded features are difficult to produce in high volume and add to the cost of manufacture.

The use of conventional machine screws in the installation of the lockset requires that the installer have an appropriate tools available, to drive the screws. The use of such tools in connection with the awkward access to the screw heads due to concealment by the door knob creates significant risk of cosmetic damage to the interior rose should the tool slip off the screw head. If such damage occurs, the installer may be required to remove and replace the interior rose and knob assembly, particularly in new construction applications. Moreover, the risk of cosmetic damage also discourages the use of power drivers, thereby further reducing the speed of installation.

In some lockset applications, particularly locksets with lever handles, it is desirable to have a torque spring associated with each of the interior and exterior knob/handle and rose assemblies which operate independently on the respective knob or handle. The use of two torque springs provides redundancy in the lockset, and also prevents sagging which may occur when handles are left unsprung. A previously unrecognized problem with the use of dual independent torque springs is that the interconnection of the spring between the rose and knob assemblies prevents the free rotation of the rose with respect to the knob or handle. In conjunction with the present invention, this problem prevents the use of dual independent torque springs on a lockset mechanism having a means for quick and tool-free installation thereof.

Therefore, it is an object of the present invention to provide a means and method of establishing a semi-permanent mechanical connection between the interior and exterior rose assemblies of a lockset which does not require the use of machine screws or similar threaded fasteners, but which can still accommodate doors of varying thicknesses, particularly in the range of 1⅜ inch to 1¾ inch.

It is another object of the present invention to provide a means and method of establishing a semi-permanent connection between the interior and exterior rose assemblies of a lockset which does not require the use of tools for installation, while still permitting easy un-installation and reuse with a minimum of tools.

It is a further object of the present invention to provide a means and method of establishing a semi-permanent mechanical connection between the interior and exterior rose assemblies of a lockset which permits very rapid installation.

It is an additional object of the present invention to provide dual independent torque springs in connection with such a quick install lockset mechanism.

It is yet another object of the present invention to provide a lockset mechanism having features for facilitating proper alignment of the interior and exterior rose assemblies during installation.

It is still a further object of the present invention to provide a lockset mechanism having a turnpiece guide for facilitating proper alignment of the lock mechanism during installation.

These and other objects, features and advantages of the present invention will become apparent from the following description when viewed in accordance with the accompanying drawings and appended claims.

BRIEF DESCRIPTION OF THE DRAWINGS

FIG. 11 is a detailed illustration of the lockset mechanism interior liner;

FIG. 12 is a detailed illustration of the lockset mechanism rose cover;

FIG. 16 is a plan view of the interior cylinder assembly showing the locking blade in an unlocked position relative to the interior liner;

FIG. 17 is similar to FIG. 16 but illustrating the locking blade in a locked position relative to the interior liner;

DETAILED DESCRIPTION OF THE INVENTION

Figure 1:
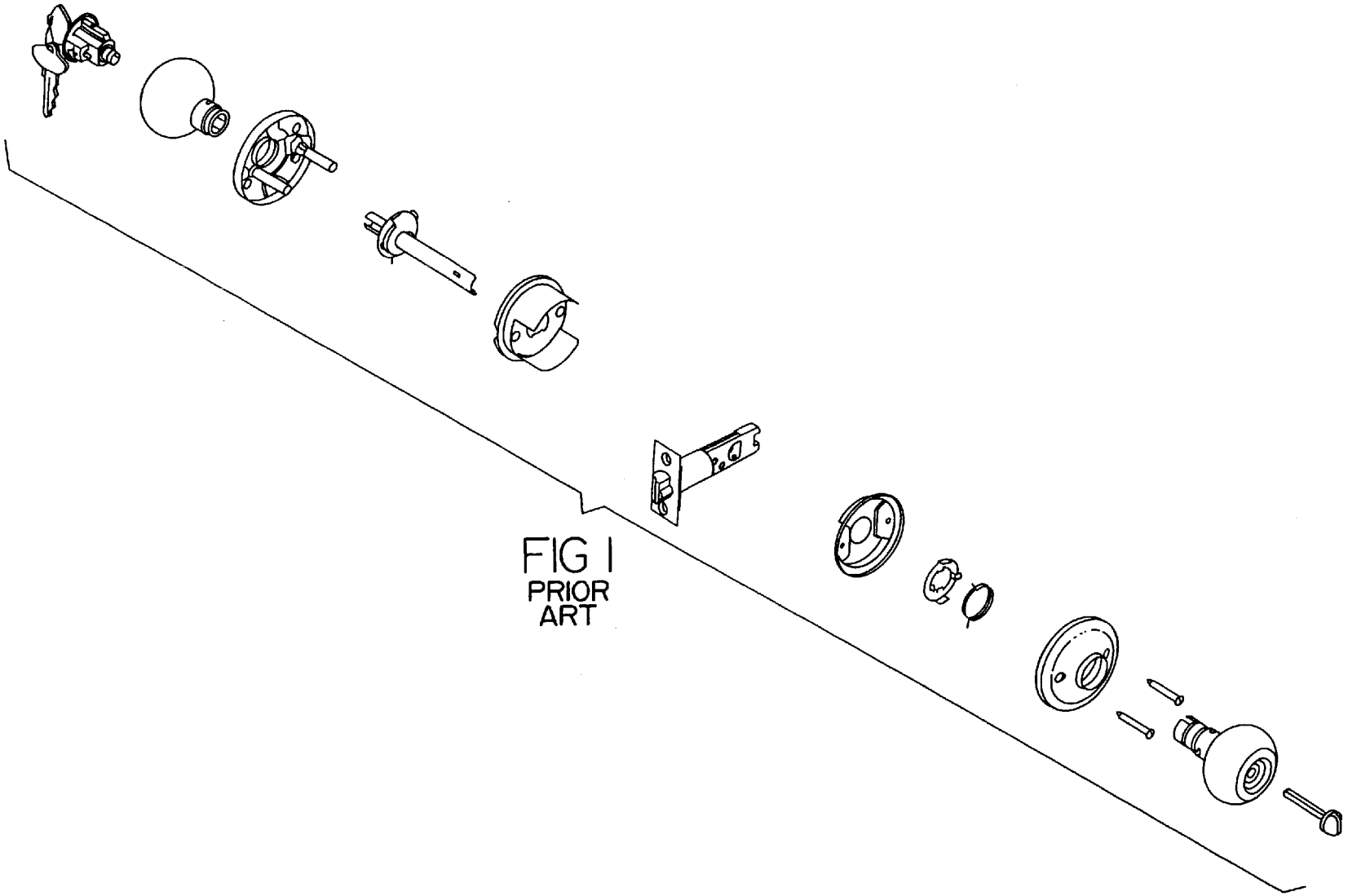
FIG 1 PRIOR ART
FIG. 1 is an exploded perspective view of a conventional lockset mechanism.
Figure 2:
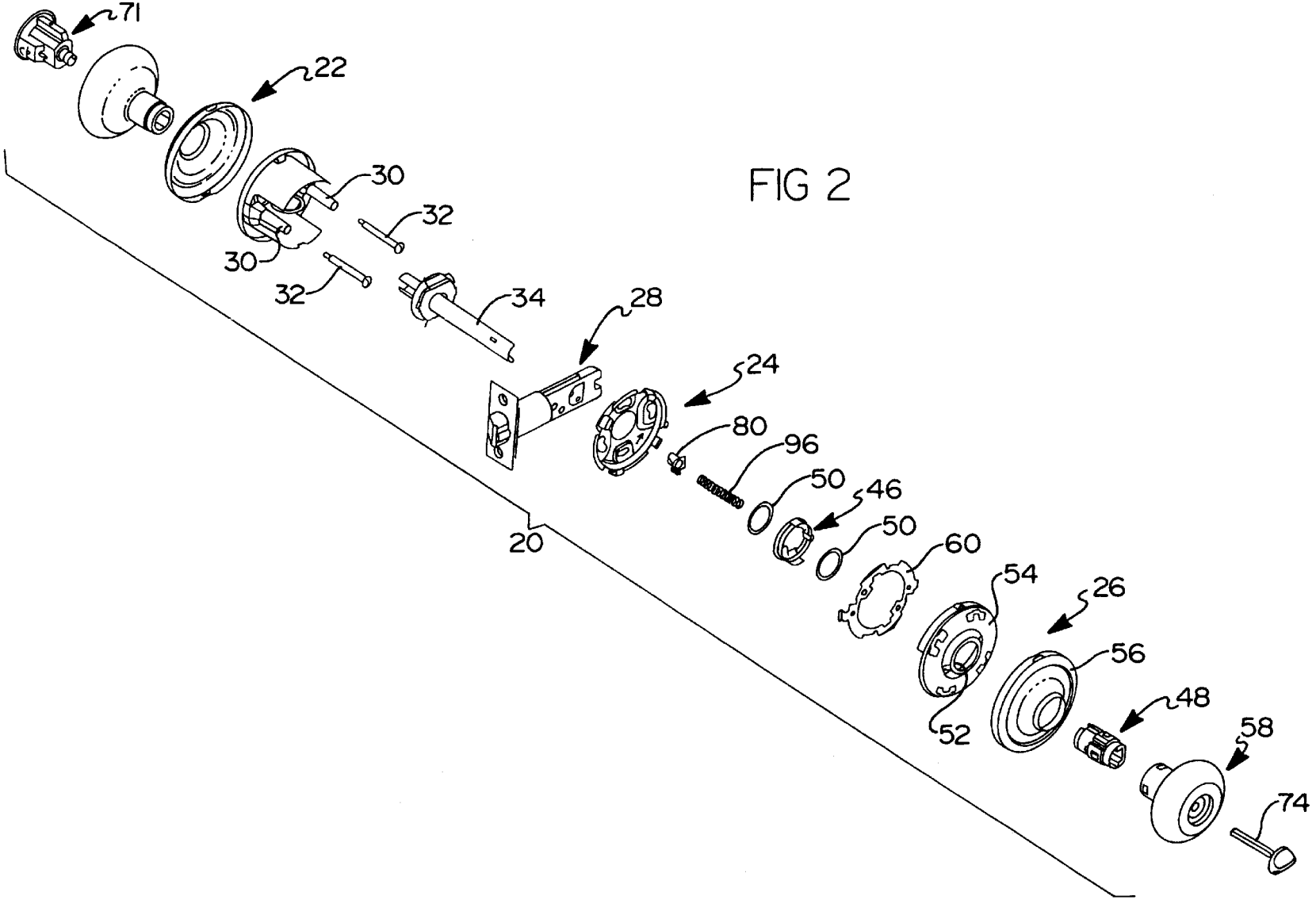
FIG. 2 is an exploded perspective view of a lockset mechanism in accordance with a preferred embodiment of the present invention.

The present invention is directed to a lockset mechanism which may be readily secured to door assemblies having various thicknesses which has certain design features to facilitate proper alignment of the lockset mechanism and rapid assembly and installation thereof. In accordance with a preferred embodiment of the present invention, lockset mechanism 20 includes exterior cylinder assembly 22, mounting plate 24, interior cylinder assembly 26 and latch bolt 28. For purposes of the present disclosure, it is understood that the door D has a first bore B formed therethrough into which lockset mechanism 20 is installed and a second bore (not shown) into which latch bolt 28 is installed as best understood from FIG. 3.

Figure 5:
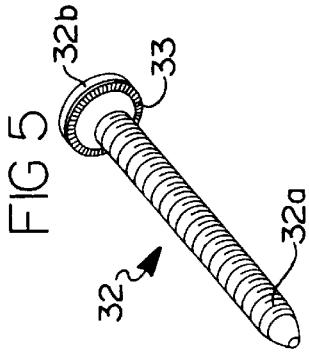
FIG. 5 is a detailed illustration of the threaded fastener used to secure the mounting plate to the exterior cylinder assembly.
Figure 3:
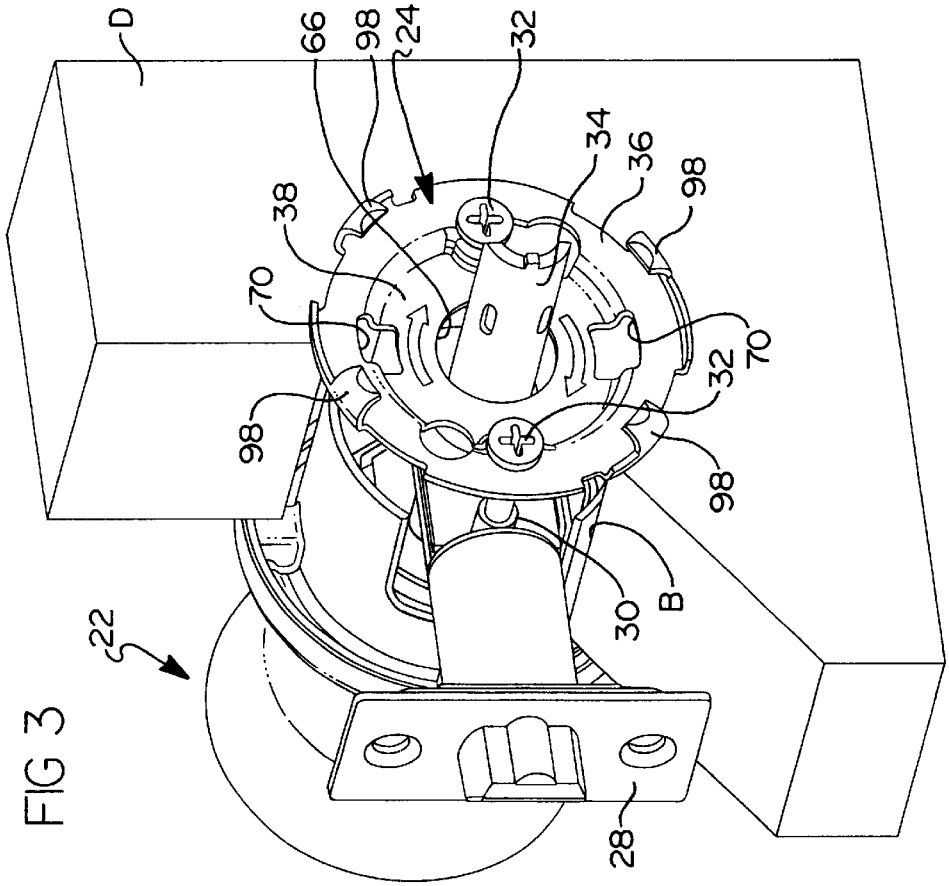
FIG. 3 is a perspective view illustrating the exterior cylinder assembly and the mounting plate.

Exterior cylinder assembly 22 has a pair of stems 30 extending axially therefrom which are adapted to receive screws 32 for providing a location onto which mounting plate 24 may be releasably secured. As best seen in FIG. 3, exterior cylinder assembly 22 is loaded from the exterior side of door D such that stem 30 and half-round 34 extend through latch bolt 28. Screw 32 has threaded shank portion 32*a* and an enlarged head portion 32*b* with a serrated surface 33*a* which tightens onto and bites into mounting plate 24 to provided a positive locked coupling between mounting plate 24 and exterior cylinder assembly 22 as best seen in FIG. 5. Mounting plate 24 has a circumferential flange 36 formed thereon which transitions into cup portion 38 and is adapted to be received in bore B formed of door D. A pair of keyhole slots 40 are defined by opening 42 and channel 44 formed in mounting plate 24 and receives screws 32 extending from stem 30.

Mounting plate 24 may be pre-positioned such that screws 32 pass through opening 42 and are able to move into channel 44 upon rotation of mounting plate 24. Screws 32 may then be tightened for releasably coupling mounting plate 24 to exterior cylinder assembly 22 with door D clamped therebetween as best seen in FIG. 3. The design of exterior cylinder assembly 22 is such that doors of varying thicknesses may be accommodated by the length of screws 32.

Interior cylinder assembly 26 includes torque spring mechanism 46 secured to cylindrical sleeve 48 by retaining rings 50. Cylindrical sleeve 48 is received within and rotatably supported by aperture 52 formed in interior liner 54. Rose cover 56 has a pair of dimples 57 formed therein for securing rose cover 56 to an outer surface of interior liner 54 as best seen in FIG. 12. Knob assembly 58 is operably coupled to sleeve 48 for rotation therewith. Locking blade 60 is releasably secured to interior liner 54 and provides means for interconnecting interior cylinder assembly 26 with mounting plate 24 as further described herein.

Figure 4:
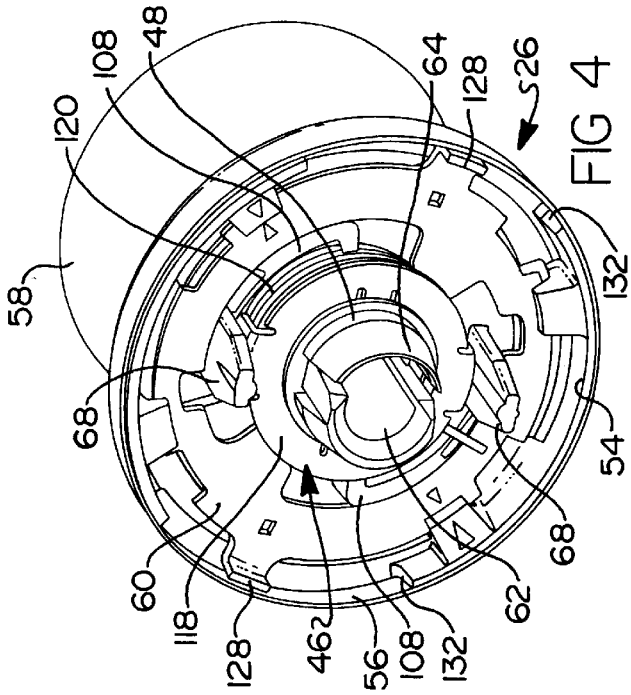
FIG. 4 is a perspective view of the interior cylinder assembly.
Figure 7:
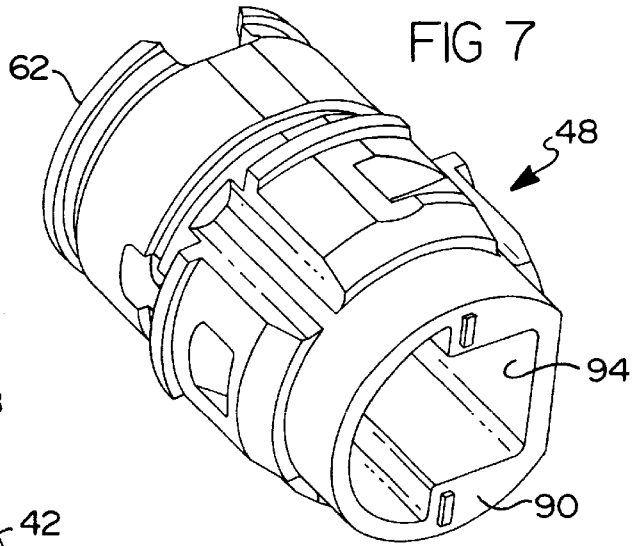
FIG. 7 is a detailed illustration of the lockset mechanism interior cylinder sleeve.

With particular reference to FIGS. 4 and 7, interior cylinder assembly 26 is provided with certain alignment features which facilitate the proper orientation and alignment of various components of lockset mechanism 20. More specifically, blocking feature 62 is formed on an interior surface of cylindrical sleeve 48 which prevents rotational misalignment of exterior cylinder assembly 22 and more specifically half-round 34. In this manner, blocking feature 62 prohibits insertion of half-round 34 along the left-hand interior face of sleeve 48 as viewed in FIG. 4. Cylindrical sleeve 48 is further provided with a tapered leading surface 64 for facilitating alignment of interior cylinder assembly 26 and more specifically interior sleeve 48 within the central aperture 66 formed in mounting plate 24. Guide posts 68 extend axially inwardly from an interior surface of interior liner 54 and rotationally align interior cylinder assembly 26 with respect to mounting plate 24. More specifically, mounting plate 24 has a pair of slots 70 formed therein which are adapted to receive guides 68 formed on interior liner 54. The leading edge of guides 68 are also tapered to facilitate proper alignment thereof. In this manner, interior cylinder assembly 26 may be quickly and easily aligned with and installed onto mounting plate 24.

Lockset mechanism 20 may be readily adapted to provide a locking function in applications such as entry doors and privacy doors. In these applications, a lock cylinder 71 is operably coupled through lockset mechanism 20 in a conventional manner. With specific reference to FIG. 13, lockset mechanism 20 includes full-round 72 which is operably coupled at one end to a lock cylinder 71 and which extends axially inwardly toward interior assembly 26. Interior cylinder assembly 26 includes turnpiece 74 having turnpiece shaft 76 extending axially toward exterior cylinder assembly 22. When properly installed, turnpiece shaft 76 is received within a blind bore 78 formed in full-round 72 for co-rotation. One skilled in the art will readily recognize that proper alignment must be achieved between turnpiece 74 and full-round 72 to provide for proper installation of lockset mechanism 20.

Figure 8:
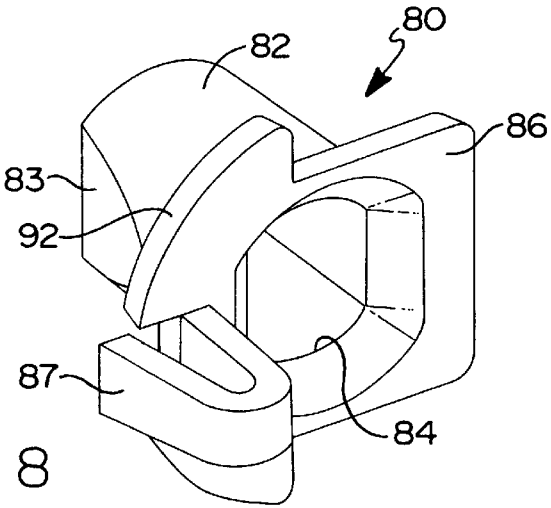
FIG. 8 is a detailed illustration of the lockset mechanism turnpiece guide.

Interior sleeve 48 is adapted to receive turnpiece guide 80 which cooperates with turnpiece 74 for assuring proper axial and rotational alignment with full-round 72. With particular reference to FIG. 8, turnpiece guide 80 includes shank portion 82 having throughbore 84 formed therethrough which is adapted to receive turnpiece shaft 76. The shank portion 82 of turnpiece guide 80 may further be provided with a chamfered or tapered face 83 to prevent interference between turnpiece guide 80 and half-round 34 during installation of interior assembly 26. Head portion 86 of turnpiece guide 80 cooperates with interior sleeve 48 to maintain the alignment of turnpiece 74 in proper orientation when lockset mechanism 20 is in an unassembled state. A compliant member 87 is formed on head portion 86 which allows turnpiece guide 80 to be loaded from the end adjacent mounting plate 24. Compliant member 87 is urged radially inwardly as turnpiece guide 80 is pushed through bore 84 of interior sleeve 48 and then springs radially outwardly once of head portion 86 is aligned with a rear surface 90 of interior sleeve 48.

Figure 14:
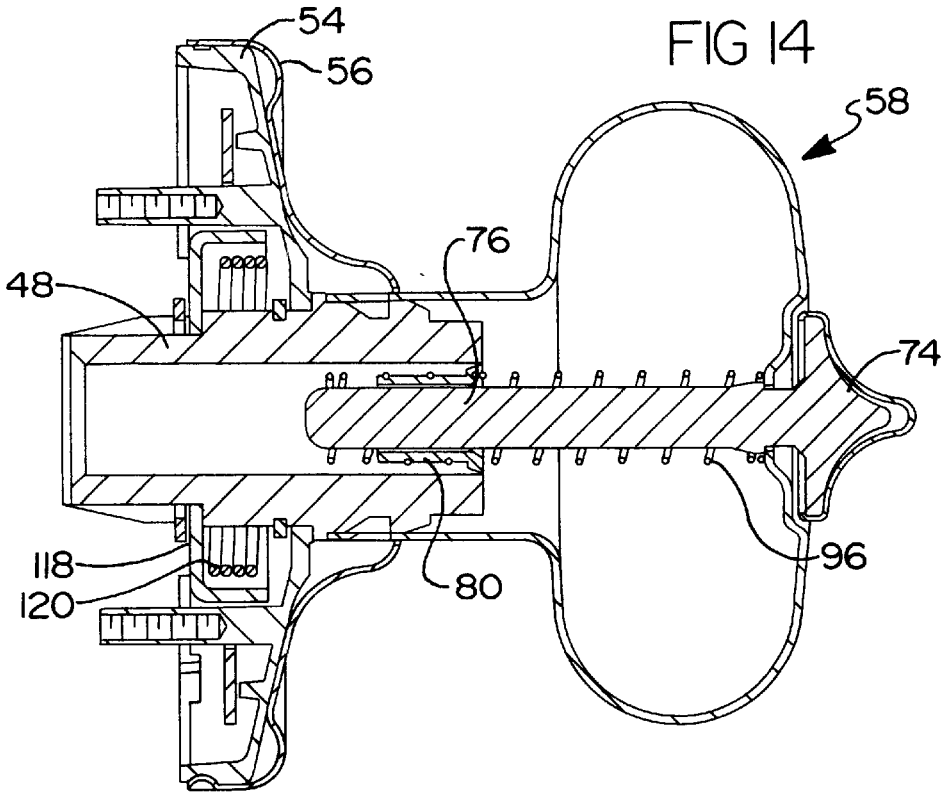
FIG. 14 is a cross-sectional view illustrating the interior cylinder assembly with the turnpiece guide located in an engaged position.
Figure 15:
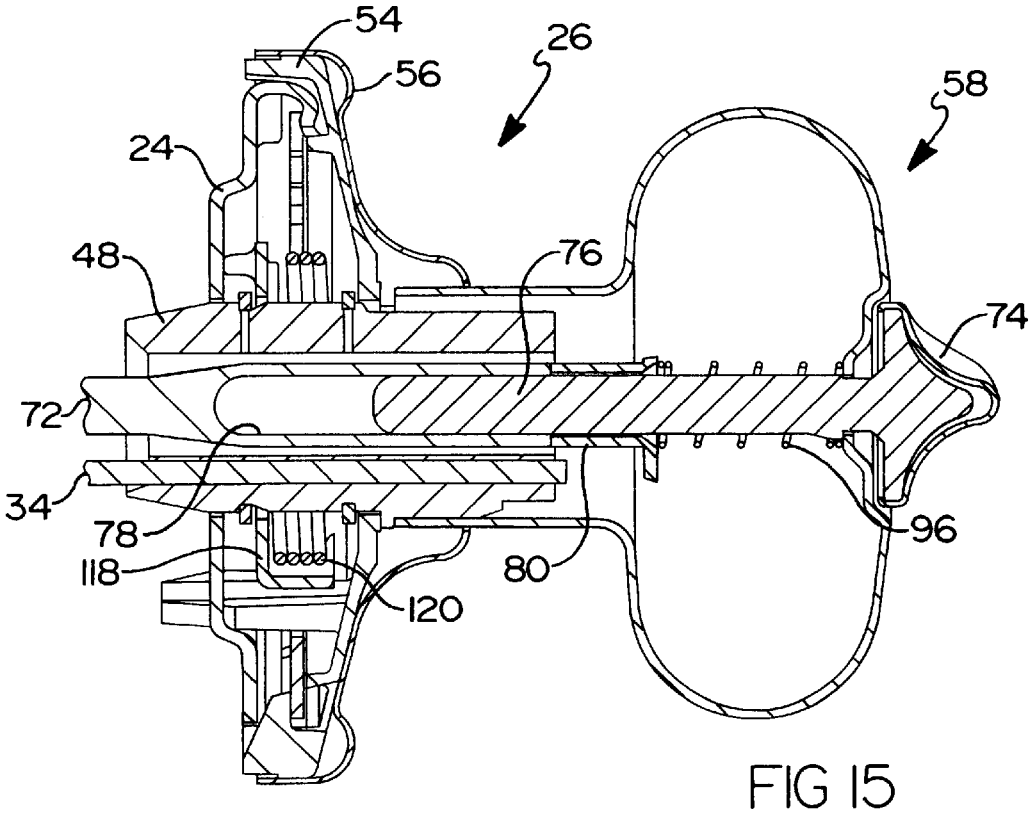
FIG. 15 is a cross-sectional view illustrating the interior cylinder assembly with the turnpiece guide displaced to a disengaged position.

Once so assembled the perimeter surface 92 of turnpiece guide 80 which has asymmetric configured on is located within the interior surfaces 94 of interior sleeve 48, thereby preventing turnpiece 74 from rotating such that turnpiece shaft 76 is aligned with full-round 72. As interior assembly 26 is positioned over mounting plate 24, full-round 72 axially displaces turnpiece guide 80 along turnpiece shaft 76, thereby disengaging perimeter surface 92 of turnpiece guide 80 from interior surface 94 of interior sleeve 48 as best seen in FIGS. 14 and 15. The axial displacement of turnpiece guide 80 allows turnpiece 74 at turnpiece guide 80 to freely rotate and operate the lock cylinder 71 of lockset mechanism 20 via full round 72.

A biasing spring 96 is incorporated into interior assembly 26 for axially biasing turnpiece guide 80 towards interior sleeve 48 such that subsequent disassembly of lockset mechanism 20 urges turnpiece guide 80 from the disengaged position towards the engaged position.

Figure 13:
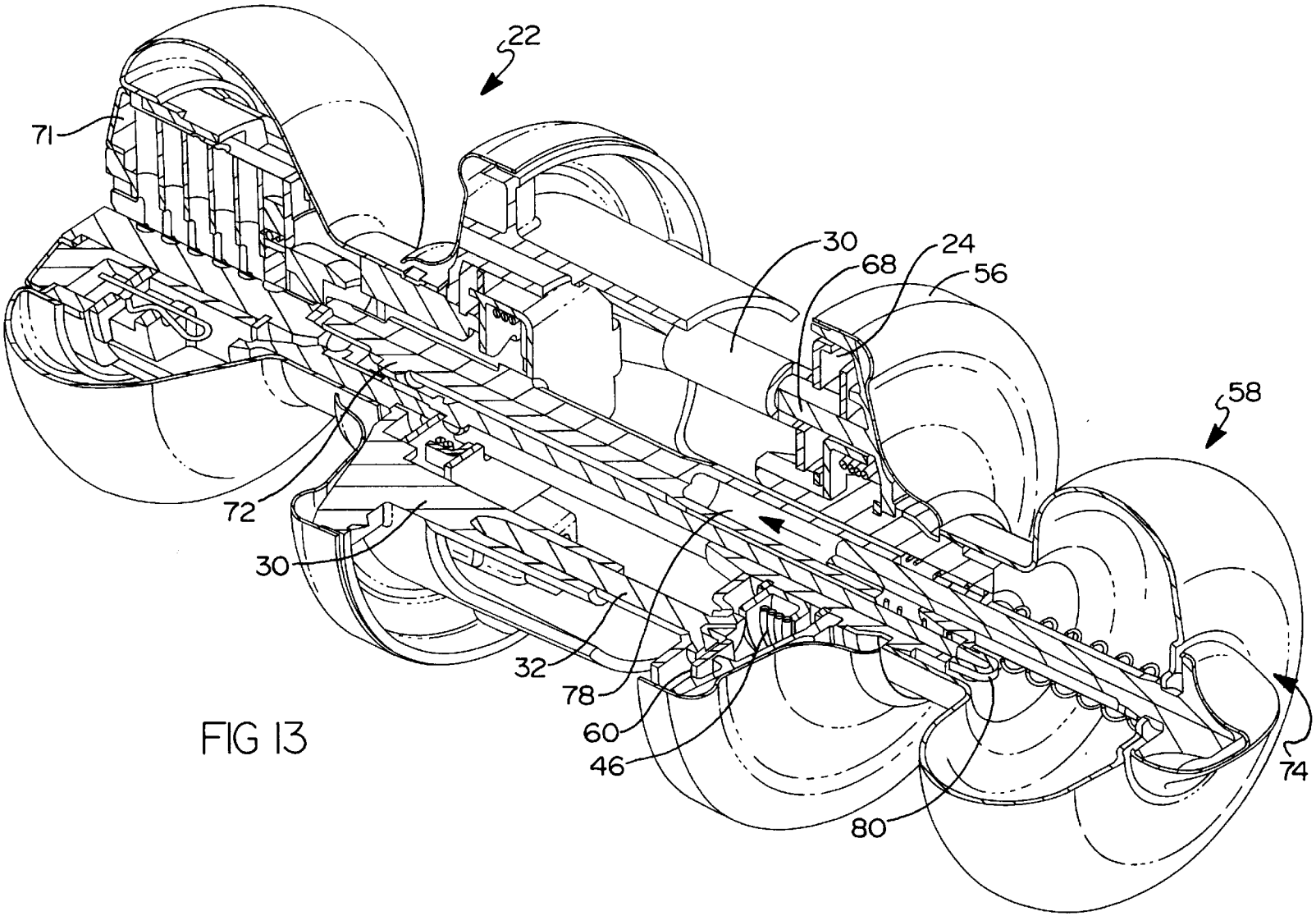
FIG. 13 is a cutaway perspective view of the lockset mechanism in an assembled state.

With reference again to FIGS. 2–17, locking blade 60 is disposed within interior liner 54 and provides a mating surface which engages a plurality of teeth 98 formed on mounting plate 24 for releasably securing interior assembly 26 onto mounting plate 24. Locking blade 60 is appropriately positioned and retained within interior liner 54 by a plurality of retaining teeth 100 extending radially inwardly from a circumferential flange 102 thereof. Interior liner 54 has an inner annular wall 104 for supporting locking blade 60 as best seen in FIG. 11. A plurality of interference nubs 106 are disposed on the edge of annular wall 104. Locking blade 60 is positioned within interior liner 26 such that it is disposed between inner annular wall 104 and retaining teeth 100 as best seen in FIGS. 4 and 13. Interference nubs 106 provide an interference fit to elastically deform or bend locking blade 60 such that it is releasably secured by friction within interior liner 54. Interior liner 54 may further include a locating hub 108 for precisely positioning the rotational orientation of locking blade 60 with respect to interior liner 54. To further facilitate installation of locking blade 60 within interior liner 54, the bottom surface 110 of retaining teeth 100 may be beveled to provide a lead-in which accommodates relative rotation of locking blade 60 with respect to interior liner 54 into the appropriate position. Locking blade 60 is rotatably positionable relative to interior liner 54 between an unlocked position as illustrated in FIG. 16 and a locked position as illustrated in FIG. 17.

Figure 6:
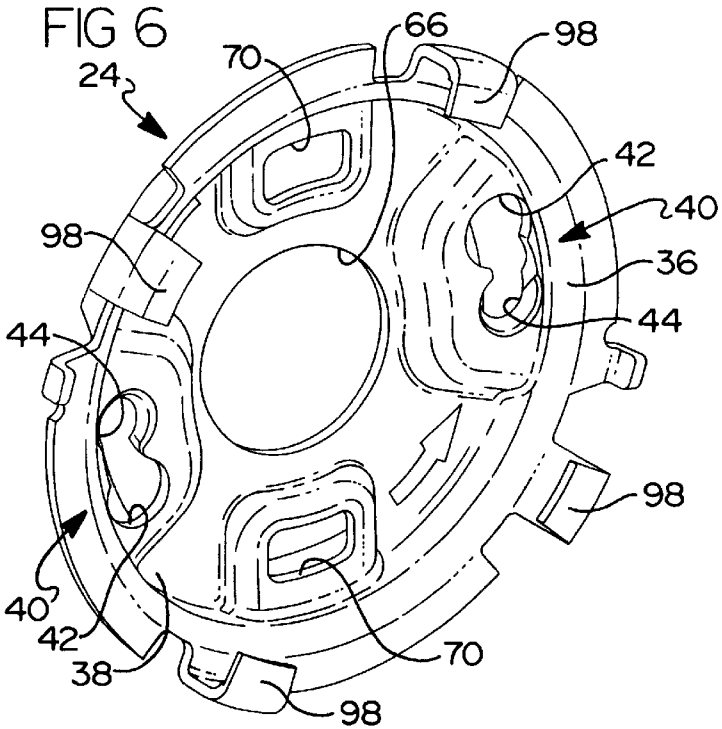
FIG. 6 is a detailed illustration of the lockset mechanism mounting plate.
Figure 9:
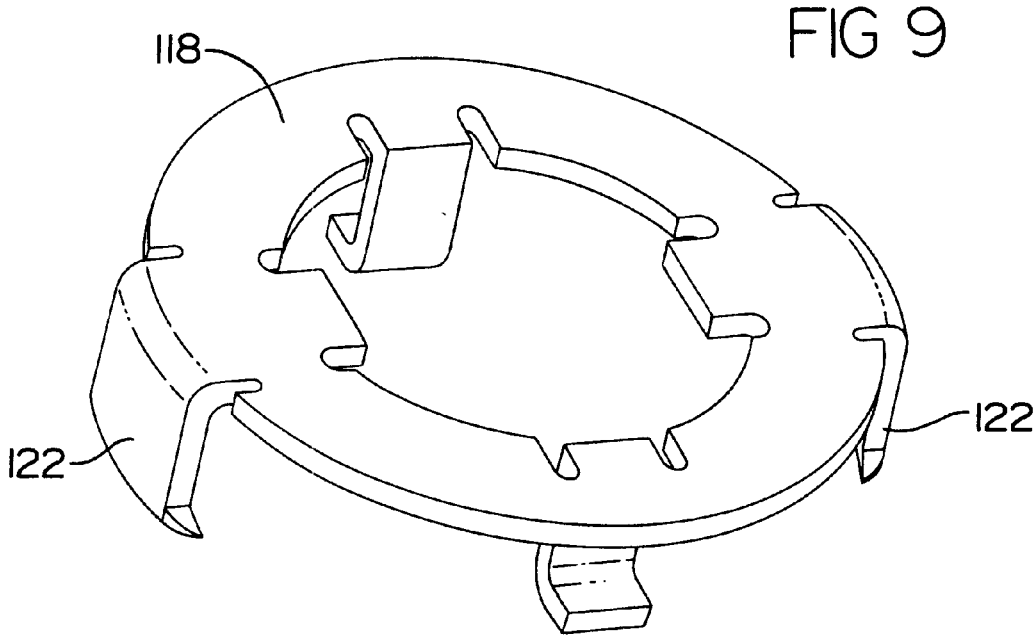
FIG. 9 is a detailed illustration of the lockset mechanism torque spring housing.

Likewise, mounting plate 24 is provided with a plurality of retaining teeth 98 formed on annular wall 104 and extending radially inwardly as best seen in FIGS. 3 and 6. Retaining teeth 98 are adapted to be received within opening 112 formed in locking blade 60 to releasably couple interior cylinder assembly 26 to mounting plate 24. Ramp portions 116 may be formed on the circumference of locking blade 60 for further facilitating engagement of locking blade 60 with mounting plate 24.

Torque spring mechanism 46 provides a dual function of providing a rotational biasing force for urging knob assembly 58 into the locked position, and also providing means for selectively rotating locking blade 60 between the unlocked position and the locked position. More specifically, torque spring mechanism 46 includes torque spring housing 118 which is operably coupled to interior sleeve 48 for rotation therewith. Torque spring 120 is operably coupled between torque spring housing 118 and interior liner 54 to generate the aforementioned biasing force. Torque spring housing 118 also has a pair of legs 122 extending axially therefrom which are disposed in a central aperture 124 formed in locking blade 60. A pair of tabs 126 formed on locking blade 60 extend radially inwardly and are adapted to selectively engage legs 122 formed on torque spring housing 118. More specifically, rotation of knob assembly 58 with respect to interior liner 54 rotates legs 122 into engagement with tabs 126 for providing driving rotation of locking blade 60 relative to interior liner 54. In this manner, locking blade 60 may be rotated in a counter-clockwise direction from an unlocked position (as shown in FIG. 16) wherein openings 112 formed in locking blade 60 are axially aligned with retaining teeth 98 of mounting plate 24 to a locked position (as shown in FIG. 17) wherein the locking blade releasably secures the interior cylinder assembly 26 to the mounting plate 24. Once locking blade 60 is located in a locked position, knob assembly 58 is free to rotate.

Figure 10:
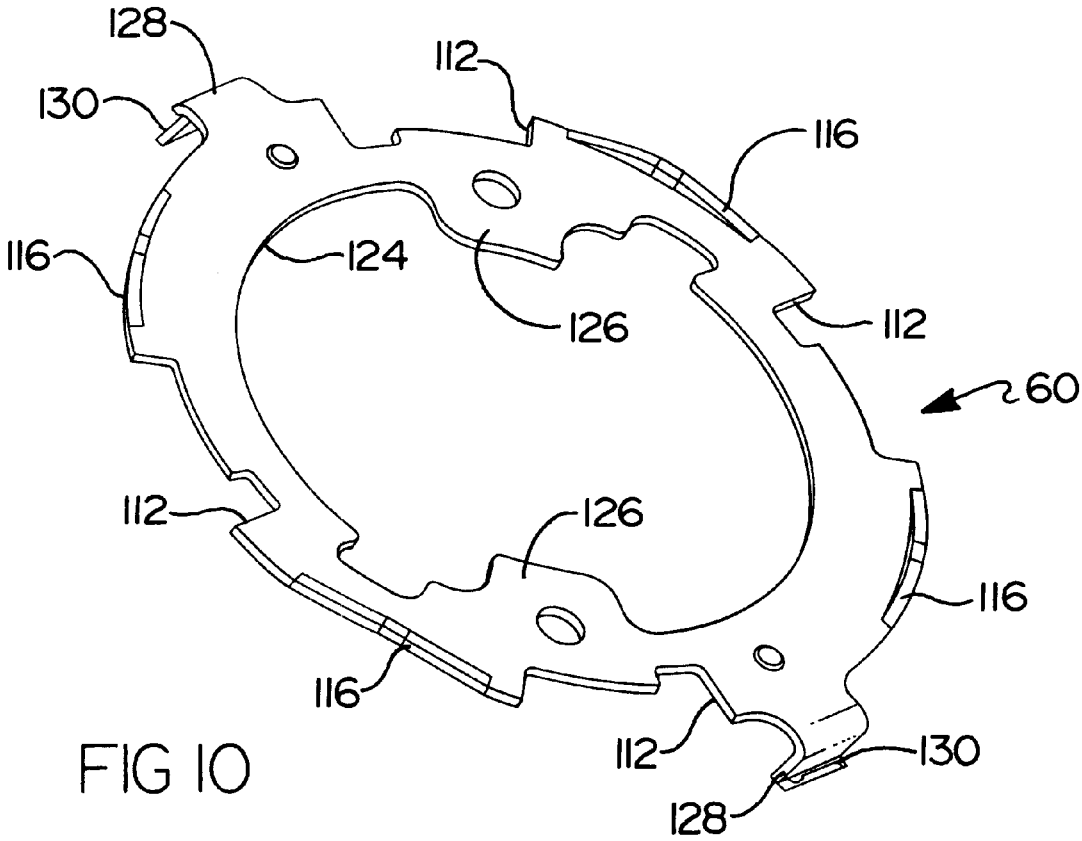
FIG. 10 is a detailed illustration of the lockset mechanism locking blade.

In the preferred embodiment of the present invention, locking blade 60 is provided with a pair of arms 128 extending outwardly therefrom as best seen in FIGS. 10 and 16–17. Notch 130 is formed in arms 128 for engaging a flat object such as a screwdriver to permit counter rotation of the locking blade. Likewise, relief 132 is formed in annular wall 104 of interior liner 54 to provide access to the arms 128.

Figure 18:
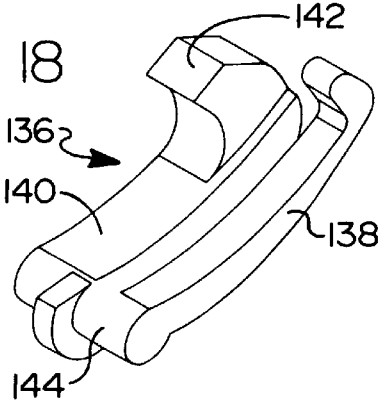
FIG. 18 is a detailed illustration of a removal catch used in an alternate embodiment of the present invention.
Figure 20:
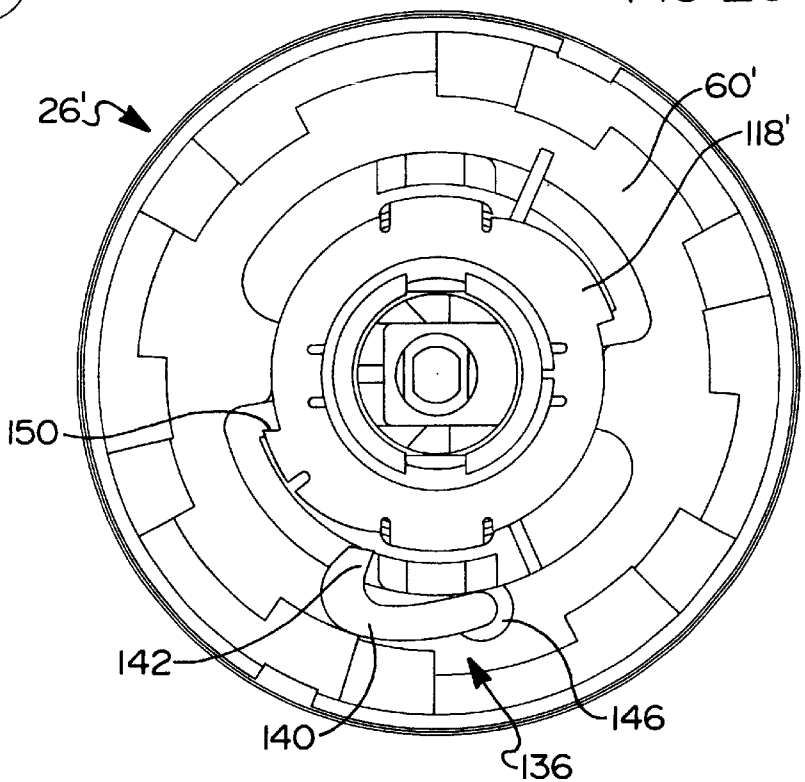
FIG. 20 is similar to FIG. 19 but illustrating the locking blade in an unlocked position relative to the interior liner.
Figure 19:
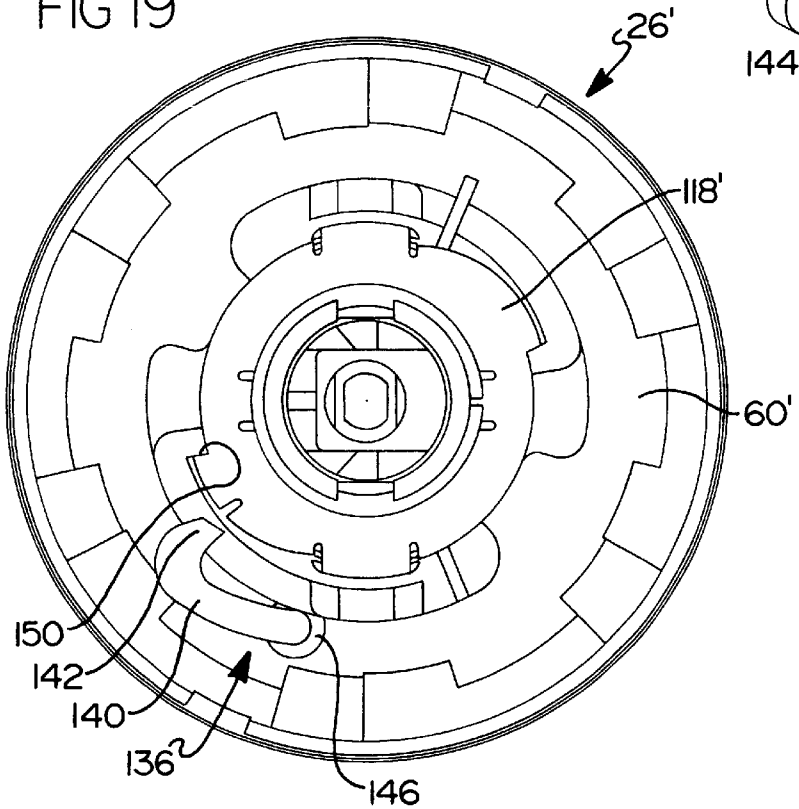
FIG. 19 is a plan view of a interior cylinder assembly of the alternate embodiment showing the locking blade in a locked position relative to the interior liner.

In an alternate embodiment of the present invention, a more complex removal mechanism is provided. With particular reference to FIGS. 18–20, interior cylinder assembly 26' is provided with a removal catch 136 which permits disassembly of interior cylinder assembly 26' from mounting plate 24. Removal catch 136 is retained by locking blade 60' and is positionable to operably engage a tab **118*a*' torque spring housing 118' whereby counter-rotation of the knob assembly will permit rotation of locking blade 60' such that retaining teeth 98 of mounting plate 24 disengage locking blade 60'. As best seen in FIG. 18, removal catch 136 includes arcuate support member 138 which is configured to abut annular wall 104 formed on interior liner 54. Removal catch 136 further includes pawl member 140 having tooth 142 formed on an end thereof and axle portion 144 adapted to be received within hemispherical slot 146 formed in locking blade 60'. Torque spring housing 118' is formed with arm 150 extending radially outwardly therefrom which selectively engages tooth 142 of release catch 136 when biased radially inwardly. Once tooth 142 engages arm 150 the torque spring housing 118' is rotationally coupled to locking blade 60' such that rotation of the knob assembly will rotate locking blade 60'**.

With continued reference to FIGS. 2–17, the assembly and installation of the preferred embodiment of the present invention will now be described. In accordance with such assembly, it is assumed that latch bolt 28 has already been installed onto door D. Initially, exterior chassis assembly 22 is inserted through bore B formed in door D. Half-round 34 and stems 30 will pass through latch bolt 28. Mounting plate 24 is appropriately positioned such that screws 32 pass through openings 42 formed in mounting plate 24. Mounting plate 24 is then rotated, thereby positioning the shank portion **32*a* of screws 32 into channels 44 of mounting plate 24. Exterior chassis assembly 22 may then be adequately secured to door D by tightening screws 32. As presently preferred, screws 32 need only be rotated a few turns since the position of the screws 32 with respect to exterior chassis assembly 22** have been pre-positioned to a pre-set depth depending on a predetermined door thickness based on the function of the lockset, i.e., entry, privacy, passage, classroom, vestibule, etc.

Next, interior chassis assembly 26 is installed onto mounting plate 24. In this regard, tapered portion 64 formed on sleeve 48 is inserted into aperture 52 formed in mounting plate 24, and guide posts 68 are inserted into slot 70 formed in mounting plate 24. Interior chassis assembly 26 is axially positioned until retaining teeth 98 of mounting plate 24 are received within opening 112 formed in locking blade 60. This axial movement of interior chassis assembly 26 causes full-round 72 to engage shank portion 82 on turnpiece guide 80. Further axial positioning of interior chassis assembly 26 relative to exterior chassis assembly 22 urges turnpiece guide 80 out of engagement from interior sleeve 48 as best seen in FIGS. 13–15. In this manner, turnpiece 74 is appropriately aligned with full-round 72 and operably coupled to locking mechanism 71 associated with lockset mechanism 20.

Once interior chassis assembly 26 is positioned in the appropriate axial location relative to mounting plate 24, knob assembly 58 may be rotated in a clockwise direction (as far as it will rotate) causing interior sleeve 48 and torque spring mechanism 116 to rotate to a point where legs 122 formed on torque spring housing 118 rotationally drive tabs 126 formed on locking blade 60. In this manner, locking blade 60 is rotatably positioned between retaining teeth 100 formed on interior liner 54 and retaining teeth 98 formed on mounting plate 24, thereby releasably securing the interior chassis assembly 26 to mounting plate 24. Once locking blade 60 is rotated into the locked position, knob assembly 58 may be released to freely rotate in a conventional manner for operating latch bolt 28.

As previously discussed, lockset mechanism 20 is adapted to permit removal of the interior chassis assembly 28 through manipulation of locking blade 60. More specifically, to remove the interior cylinder assembly 26 from mounting plate 24, the interior rose cover 56 is removed from interior liner 54 by inserting a flat object such as a screwdriver into recess 152 and prying the rose cover 56 off interior liner 54. Once rose cover 56 is removed, the removal arms 130 formed on locking blade 60 are accessible through relief 132 formed in interior liner 54 exposed. A flat object such as a screwdriver may be inserted through the relief 132 and positioned in notch 130 so as to engage removal arm 128. Pushing on the removal arms 128 causes locking blade 60 to rotate backwards and ultimately aligning the teeth 98 of mounting plate 24 with the openings 112 in locking blade 60. The biasing spring 96 causes the turnpiece guide 80 to return to a position where the rear surface 88 of the turnpiece guide 80 is flush with the rear surface 90 of the cylindrical sleeve 48. Thus, the interior cylinder assembly 26 can be removed, and all components associated with the interior cylinder assembly 26 will be returned to their original position prior to installation.

As previously discussed, lockset mechanism 20 may be adapted with an alternate embodiment for removal mechanism 128 to permit removal of interior chassis assembly 26 upon actuation of removal catch 136. To initiate such disassembly, rose cover 56 is popped off from interior liner 54 by inserting a small flat object such as a screw driver into recess 152 formed in an annular wall of rose cover 56, and prying rose cover 56 off to expose interior liner 54. Next, the small flat object may be inserted into relief 132 formed in interior liner 54 to engage and inwardly bias pawl 140 of removal catch 136. This inwardly biasing action causes tooth 142 to move radially inwardly such that it is positioned to engage arm 150 formed on torque spring housing 118. Once tooth 142 engages arm 150 knob assembly 58 is rotatably coupled to locking blade 60 which may be counter-rotated to the unlocked position. At this point, rotating knob assembly 58 back to the neutral position will rotate locking blade 60 back to the unlocked position wherein retaining teeth 98 formed on mounting plate 24 are able to pass through openings 112 on locking blade 60, thereby allowing disassembly of interior chassis assembly 26 from mounting plate 24.

While the present invention has been described with particular reference to preferred embodiments of a lockset mechanism, one skilled in the art will recognize that the present invention may be readily adapted to embodiments other than those described with reference to the preferred embodiments. Furthermore, those skilled in the art will readily recognize from the foregoing discussion and accompanying drawings and claims, that changes, modifications and variations can be made in the present invention without departing from the spirit and scope thereof as defined in the following claims.

What is claimed is:

1. A lockset mechanism comprising:

a first cylinder assembly having a first coupling member formed thereon and a first handle assembly operably associated therewith;

a mounting plate interconnected to said first cylinder assembly by said first coupling member, said mounting plate having a second coupling member formed thereon;

a second cylinder assembly having a second handle assembly operably associated therewith; and a locking member interposed between said mounting plate and said second cylinder assembly, said locking member being rotatably positionable between a locked position wherein said locking member engages said second coupling member to secure said second cylinder assembly to said mounting plate, and an unlocked position wherein said locking plate disengages said second coupling member to release said second cylinder assembly from said mounting plate.

2. The lockset mechanism of claim 1, wherein said mounting plate comprises a perimeter flange having a pair of keyhole slots formed therein to receive said first coupling member.

3. The lockset mechanism of claim 1, wherein said second coupling member comprises a plurality of retaining teeth disposed around a perimeter flange and extending inwardly.

4. The lockset mechanism of claim 3, wherein said locking member has a plurality of openings along a perimeter such that said second coupling members are received through said plurality of openings when said locking member is in said unlocked position.

5. The lockset mechanism of claim 4, wherein at least one of said second coupling members and said locking member comprises a ramp portion for facilitating engagement of said retaining teeth with said locking member.

6. The lockset mechanism of claim 1, further comprising a third coupling member formed on said second cylinder assembly, said third coupling member including a plurality of retaining teeth extending inward from a perimeter flange, said locking member disposed between said plurality of retaining teeth and said second cylinder assembly.

7. The lockset mechanism of claim 6, wherein said locking member includes a central aperture having a tab extending radially inwardly, and said second cylinder assembly further includes a torque spring assembly including a torque spring housing having an axially extending leg, adapted to be received within said aperture of said locking member and selectively engagable with said tab.

8. The lockset mechanism of claim 7, wherein said torque spring assembly further comprises a torque spring biasing said locking member to said locked position.

9. The lockset mechanism of claim 7, wherein said locking member includes an arm extending outwardly therefrom and engaged with said second cylinder assembly to prevent said locking member from rotating from said locked position to said unlocked position.

10. The lockset mechanism of claim 9, wherein said arm of said locking member has a notch formed therein for engagement by a tool to allow said locking member to rotate from said locked position to said unlocked position.

11. The lockset mechanism of claim 7, further comprising a removal catch disposed on said locking member, said removal catch selectively positionable to selectively engage said torque spring housing.

12. The lockset mechanism of claim 11, wherein said removal catch includes an axle portion fitted within a slot formed in said locking member and a pawl member having a tooth formed on an end thereof, said pawl member selectively engagable with an arm formed in said torque spring housing.

13. A method of installing a lockset mechanism into a door, the door having a bore formed therethrough, the method comprising:

positioning a first cylinder assembly such that a first coupling member extends through a bore of a door;

securing a mounting plate to said first coupling member such that said mounting plate and said first cylinder assembly are secured to said door;

positioning a second cylinder assembly over said mounting plate such that a second coupling member of said mounting plate is covered by said second cylinder assembly; and rotating a locking member interposed between said mounting plate and said second cylinder assembly to engage said second coupling member and secure said second cylinder assembly to said mounting plate.

14. The method of installing the lockset mechanism of claim 13, wherein during positioning of said second cylinder, retaining teeth disposed on said mounting plate extend through openings formed in said locking member.

15. The method of installing the lockset mechanism of claim 13, wherein during rotation of said second cylinder assembly, legs extending from said second cylinder assembly engage tabs formed on said locking member to rotate the locking member to a locked position with respect to the mounting plate, thereby securing the second cylinder assembly to the first cylinder assembly.

16. A lockset mechanism comprising:

a first cylinder assembly including a first handle and a shaft extending axially away from said first handle, said shaft having a blind bore formed in an end thereof opposite said first handle;

a second cylinder assembly including a second handle, a sleeve extending toward said first cylinder assembly and a turnpiece having a turnpiece shaft extending into said sleeve;

a turnpiece guide received within said sleeve and having an aperture formed therein, said turnpiece shaft being received within said aperture such that said turnpiece guide is slidably positionable along said turnpiece shaft from an engaged position to couple said turnpiece shaft with respect to said sleeve for co-rotation and a disengaged position to uncouple said turnpiece shaft with respect to said sleeve from co-rotation;

wherein said turnpiece guide aligns said turnpiece shaft with respect to said blind bore.

17. The lockset mechanism of claim 16, wherein said aperture of said sleeve is asymmetrical in shape.

18. The lockset mechanism of claim 16, wherein said shaft slides said turnpiece guide from said engaged position to said disengaged position along said turnpiece shaft when said shaft slides over said turnpiece shaft.

19. The lockset mechanism of claim 16, wherein said turnpiece guide includes a head portion and a shank portion having a tapered face adapted to be received within said sleeve.

20. The lockset mechanism of claim 19, wherein said turnpiece guide further comprises a compliant member extending from said head portion to locate said turnpiece guide relative to said sleeve.

21. The lockset mechanism of claim 16, wherein said turnpiece guide is biased to said engaged position by a spring operably disposed between said turnpiece guide and said second cylinder assembly.

* * * * *

UNITED STATES PATENT AND TRADEMARK OFFICE

CERTIFICATE OF CORRECTION

PATENT NO. : 6,598,440 B1
DATED : July 29, 2003
INVENTOR(S) : Steven Armstrong

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 5,598,726 | 2/1997 | Cordle |
| 5,388,307 | 2/1995 | Hyde |
| 6,038,894 | 3/2000 | Hu |
| 5,809,815 | 9/1998 | Lee |
| 3,994,608 | 11/1976 | Swiderski et al. |
| 4,441,230 | 4/1984 | Howie, Jr. |
| 4,127,342 | 11/1978 | Coggiola |
| 5,666,833 | 9/1997 | Gao et al. |
| 5,820,178 | 10/1998 | Ellis et al. |
| 6,425,273 | 7/2002 | Kim et al. |
| 6,223,572 | 5/2001 | Marttinen |
| 3,934,437 | 1/1976 | Crepinsek |
| 3,853,341 | 12/1974 | MacDonald |
| 3,508,777 | 4/1970 | McBurnie |
| 5,683,127 | 11/1997 | Chamberlain |
| 6,131,970 | 10/2000 | Hurst et al |
| 5,636,882 | 6/1997 | Hook |
| 2,759,754 | 8/1956 | Kaiser |
| 2,440,509 | 4/1948 | Hagstrom |
| 2,329,379 | 9/1943 | Andersen -- |

Signed and Sealed this

Thirteenth Day of July, 2004

JON W. DUDAS
*Acting Director of the United States Patent and Trademark Office*